US012557847B2

(12) United States Patent
Kabirat

(10) Patent No.: US 12,557,847 B2
(45) Date of Patent: Feb. 24, 2026

(54) ELECTRONIC AEROSOL PROVISION SYSTEM

(71) Applicant: Nicoventures Trading Limited, London (GB)

(72) Inventor: Junior Kabirat, London (GB)

(73) Assignee: Nicoventures Trading Limited, London (GB)

( * ) Notice: Subject to any disclaimer, the term of this patent is extended or adjusted under 35 U.S.C. 154(b) by 647 days.

(21) Appl. No.: 17/608,420

(22) PCT Filed: May 1, 2020

(86) PCT No.: PCT/GB2020/051072
§ 371 (c)(1),
(2) Date: Nov. 2, 2021

(87) PCT Pub. No.: WO2020/225534
PCT Pub. Date: Nov. 12, 2020

(65) Prior Publication Data

US 2022/0211111 A1 Jul. 7, 2022

(30) Foreign Application Priority Data

May 3, 2019 (GB) ..... 1906279

(51) Int. Cl.
*A24F 40/485* (2020.01)
*A24F 40/10* (2020.01)
(Continued)

(52) U.S. Cl.
CPC ..... *A24F 40/485* (2020.01); *A24F 40/10* (2020.01); *A24F 40/42* (2020.01); *A24F 40/50* (2020.01)

(58) Field of Classification Search
None
See application file for complete search history.

(56) References Cited

U.S. PATENT DOCUMENTS

2015/0201674 A1* 7/2015 Dooly ..... A24F 40/42 131/328
2016/0128389 A1* 5/2016 Lamb ..... G01L 9/0072 131/328
(Continued)

FOREIGN PATENT DOCUMENTS

EP 3 162 229 A1 5/2017
JP 2011517489 A 6/2011
(Continued)

OTHER PUBLICATIONS

International Search Report and Written Opinion for International Application No. PCT/GB2020/051072, dated Sep. 15, 2020, 15 pages.
(Continued)

*Primary Examiner* — Linda L Gray
(74) *Attorney, Agent, or Firm* — Merchant & Gould P.C.

(57) ABSTRACT

An aerosol provision system comprises a reservoir for containing an aerosol precursor material; an inlet port and an outlet port both fluidly connected to the reservoir; and a control unit configured to supply a pressurized fluid to the reservoir via the inlet port to increase the pressure within the reservoir relative to the pressure external to the reservoir to force the aerosol precursor material to exit the reservoir via the outlet port.

23 Claims, 7 Drawing Sheets

(51) Int. Cl.
*A24F 40/42* (2020.01)
*A24F 40/50* (2020.01)

(56) References Cited

U.S. PATENT DOCUMENTS

| | | | |
|---|---|---|---|
| 2017/0360095 | A1 | 12/2017 | Batista |
| 2018/0249762 | A1 | 9/2018 | Daryani et al. |
| 2018/0303160 | A1 | 10/2018 | Davis et al. |

FOREIGN PATENT DOCUMENTS

| | | | |
|---|---|---|---|
| JP | 2017538409 | A | 12/2017 |
| RU | 2656823 | C2 | 6/2018 |
| RU | 2666502 | C2 | 9/2018 |
| WO | 2009122281 | A1 | 10/2009 |
| WO | 2015066121 | A1 | 5/2015 |
| WO | 2015066136 | A1 | 5/2015 |
| WO | 2016118005 | A1 | 7/2016 |
| WO | WO 2016/198459 | A1 | 12/2016 |
| WO | WO 2017/011419 | A1 | 1/2017 |
| WO | 2017108394 | A1 | 6/2017 |
| WO | 2017108429 | A1 | 6/2017 |
| WO | WO 2017/108268 | A1 | 6/2017 |
| WO | 2017130138 | A1 | 8/2017 |
| WO | 2018099664 | A1 | 6/2018 |
| WO | WO 2018/193339 | A1 | 10/2018 |

OTHER PUBLICATIONS

"Decision to Grant received for Russian Patent Application No. 2021132133, mailed on Mar. 10, 2023", 10 pages.

"International Preliminary Report on Patentability for Application No. PCT/GB2020/051072, mailed on Nov. 18, 2021", 10 pages.

"Notice of Reason for Refusal received for Japanese Patent Application No. 2021-562353, mailed on Jan. 24, 2023", 8 pages (4 pages of English Translation and 4 pages of Official Copy).

"Office Action and Search Report received for Chinese Patent Application No. 202080032636.8, mailed on May 30, 2023", 14 pages. (7 pages of English Translation and 7 pages of Official Copy).

"Search Report received for Japanese Patent Application No. 2021-562353, mailed on Jan. 20, 2023", 25 pages (14 pages of English Translation and 11 pages of Official Copy).

Office Action; Canadian Intellectual Property Office; CA Application No. 3,138,391; dated Nov. 14, 2024; 7 pgs.

* cited by examiner

ELECTRONIC AEROSOL PROVISION SYSTEM

CROSS-REFERENCE TO RELATED APPLICATIONS

This application is a National Phase entry of PCT Application No. PCT/GB2020/051072, filed May 1, 2020, which claims priority to GB 1906279.3, the entire disclosures of which are incorporated herein by reference

FIELD

The present disclosure relates to electronic aerosol provision systems such as electronic cigarettes and the like.

BACKGROUND

Electronic aerosol provision systems such as electronic cigarettes (e-cigarettes) generally contain a reservoir of a source liquid containing a formulation, typically including nicotine, from which a vapor is generated, e.g. through heat vaporisation. A vapor source for an aerosol provision system may thus comprise a heater having a wicking element arranged to receive source liquid from the reservoir, for example through wicking/capillary action. While a user inhales on the system, electrical power is supplied to the heating element to vaporise source liquid in the vicinity of the heating element to generate a vapor for inhalation by the user. Such systems are usually provided with one or more air inlet holes located away from a mouthpiece end of the system. When a user sucks on a mouthpiece connected to the mouthpiece end of the system, air is drawn in through the air inlet holes and past the vapor source. There is a flow path connecting between the vapor source and an opening in the mouthpiece so that air drawn past the vapor source continues along the flow path to the mouthpiece opening, carrying some of the vapor from the vapor source with it in the form of an aerosol. The aerosol exits the aerosol provision system through the mouthpiece opening for inhalation by the user.

In such systems, the vapor source and heating element may be provided in a disposable "cartomizer", which is a component that includes both a reservoir for receiving the source liquid and a heating element. The cartomizer is coupled in use to a reusable part (sometimes referred to as "device" part) that includes various electronic components that can be used to operate the aerosol provision system, such as control circuitry and a battery. The heating element is provided with electrical power from the battery via an electrical connection between the cartomizer and reusable device part. Once the source liquid in the cartomizer is used up (e.g., substantially all the source liquid is vaporised and inhaled), the user replaces the cartomizer and installs a new cartomizer to continue generating and inhaling vaporised liquid.

In the electronic aerosol provision systems described above, the source liquid is generally contained in the reservoir, but in some instances can exit the reservoir via the wicking element (which is usually a fibrous material in fluid communication with the reservoir). The wicking element uses the capillary effect to transport liquid from the reservoir. The source liquid may be retained in the wicking element to some extent via the capillary forces or surface tension of the liquid, but leakage of the source liquid still occurs in some instances. This can cause multiple issues for the user of the aerosol provision systems including leakage of the source liquid out of the system (and onto the user's appendages or clothing) and liquid collection (e.g. pooling) in the system, which can impact the overall aerosol formed leading to less consistent or less pleasant experiences. In addition, leakage of the source liquid may also occur when changing the cartomizer component (which may inherently impart mechanical forces to the liquid held in the wicking element by the user moving the cartomizer).

Various approaches are described which seek to help address some of these issues.

SUMMARY

According to a first aspect of certain embodiments there is provided an aerosol provision system comprising: a reservoir for containing an aerosol precursor material; an inlet port and an outlet port both fluidly connected to the reservoir; and a control unit configured to supply a pressurized fluid to the reservoir via the inlet port to increase the pressure within the reservoir relative to the pressure external to the reservoir to force the aerosol precursor material to exit the reservoir via the outlet port.

According to a second aspect of certain embodiments there is provided an aerosol provision device comprising a control unit configured to allow a pressurized fluid to enter a reservoir for containing an aerosol precursor material via an inlet port fluidly connected to the reservoir to increase the pressure within the reservoir relative to the pressure external to the reservoir to force the aerosol precursor material to exit the reservoir via an outlet port fluidly connected to the reservoir.

According to a third aspect of certain embodiments there is provided a cartridge including a reservoir for containing an aerosol precursor material, and an inlet port for receiving a pressurized fluid and an outlet port both fluidly connected to the reservoir, wherein the cartridge is configured to permit the release of aerosol precursor material from the outlet port when the pressure in the reservoir exceeds a threshold value.

According to a fourth aspect of certain embodiments there is provided a method of dispensing aerosol precursor material from a reservoir, the reservoir comprising an inlet port and an outlet port fluidly coupled to the reservoir, the method comprising permitting a pressurized fluid to enter the reservoir via the inlet port to increase the pressure within the reservoir relative to the pressure external to the reservoir, and dispensing aerosol precursor material from the reservoir in response to the increased pressure forcing the aerosol precursor material to exit the reservoir via the outlet port.

According to a fifth aspect of certain embodiments there is provided a method of dispensing aerosol precursor material from a reservoir, the method comprising increasing the pressure within the reservoir to a value greater than or equal to a threshold value, above which aerosol precursor material is permitted to exit the reservoir and below which aerosol precursor material is not permitted to exit the reservoir.

It will be appreciated that features and aspects of the disclosure described above in relation to the first and other aspects of the disclosure are equally applicable to, and may be combined with, embodiments of the disclosure according to other aspects of the disclosure as appropriate, and not just in the specific combinations described above.

BRIEF DESCRIPTION OF THE DRAWINGS

Embodiments of the disclosure will now be described, by way of example only, with reference to the accompanying drawings, in which.

DETAILED DESCRIPTION

Figure 1:
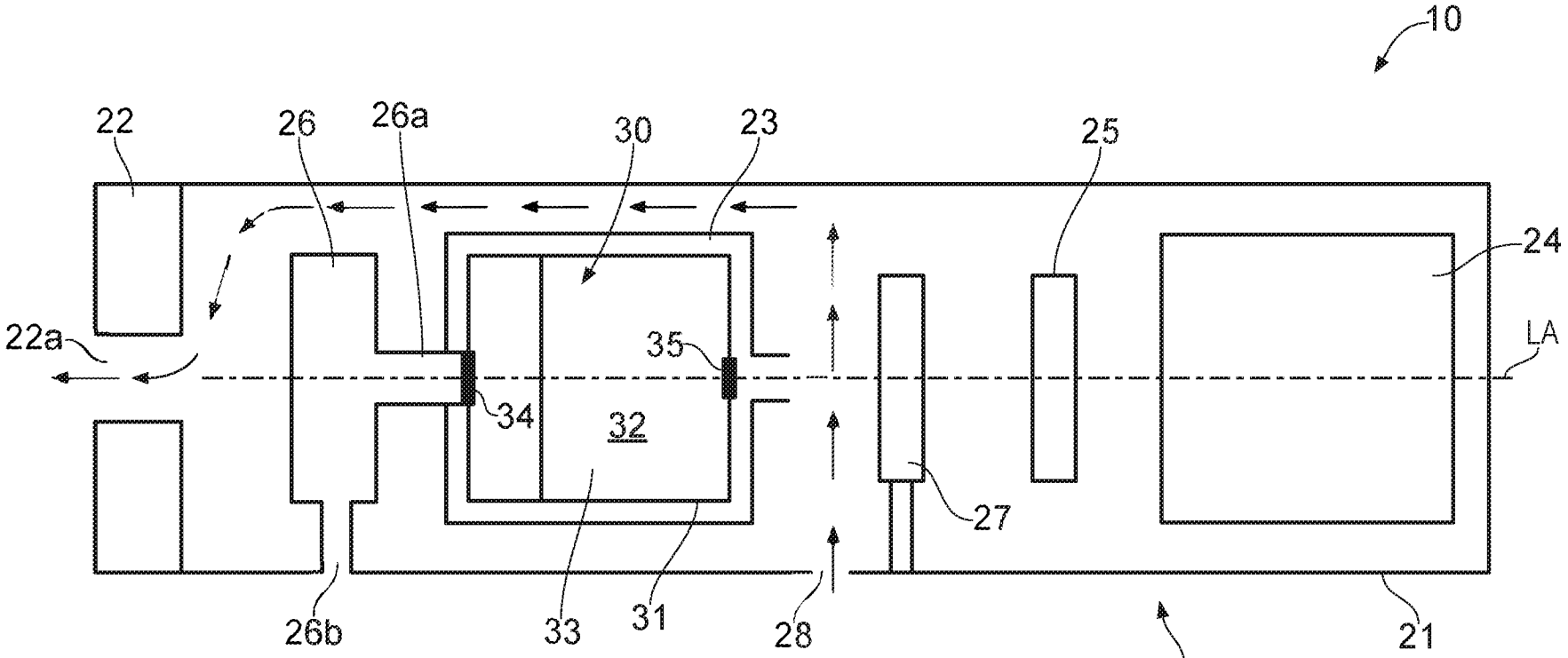
FIG. 1 schematically represents an aerosol provision system in accordance with the principles of this disclosure which includes a device part having a pressurized fluid generator for controlling the flow of a liquid or other suitable aerosol precursor material from a reservoir of a cartridge part using the generated pressurized fluid.

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

The present disclosure relates to aerosol provision systems, which may also be referred to as vapor provision systems, such as e-cigarettes. Throughout the following description the term "e-cigarette" or "electronic cigarette" may sometimes be used; however, it will be appreciated this term may be used interchangeably with aerosol provision system and electronic aerosol provision system. The disclosure is applicable to systems configured to aerosolise, e.g., via heating, a source liquid, which may or may not contain nicotine, to generate an aerosol. However, the disclosure is also applicable to systems configured to release compounds by heating, but not burning, a solid/or amorphous solid substrate material. The substrate material may be for example tobacco or other non-tobacco products, which may or may not contain nicotine. In some systems, the solid/amorphous solid materials are provided in addition to a liquid substrate material so that the present disclosure is also applicable to hybrid systems configured to generate aerosol from a combination of substrate materials. More generally, the substrate materials may comprise for example solid, liquid or amorphous solid, all which may or may not contain nicotine. A hybrid system may comprise any combination of liquid, amorphous solid, and a solid substrate materials. The term "aerosolizable substrate material" or "aerosol precursor material" as used herein is intended to refer to substrate materials which can form an aerosol, either through the application of heat or by some other means. Furthermore, and as is common in the technical field, the terms "vapor" and "aerosol", and related terms such as "vaporise", "volatilise" and "aerosolise", may also be used interchangeably.

Aerosol provision systems (e-cigarettes) often, though not always, comprise a modular assembly including both a reusable part (control unit part) and a replaceable (disposable) cartridge part. Often the replaceable cartridge part will comprise the aerosol precursor material and the atomizer assembly, and the control unit part will comprise the power supply (e.g. rechargeable battery) and control circuitry. It will be appreciated these different parts may comprise further elements depending on functionality. For example, the control unit part may comprise a user interface for receiving user input and displaying operating status characteristics. Cartridge parts are mechanically coupled to a control unit part for use, for example using a screw thread, latching or bayonet fixing. When the aerosol precursor material in a cartridge part is exhausted, or the user wishes to switch to a different cartridge part having a different aerosol precursor material, a cartridge part may be removed from the control unit and a replacement cartridge part attached in its place. Devices conforming to this type of two-part modular configuration may generally be referred to as two-part devices. It is also common for electronic cigarettes to have a generally elongate shape. For the sake of providing a concrete example, certain embodiments of the disclosure described herein will be taken to comprise this kind of generally elongate two-part device employing disposable cartridges parts. However, it will be appreciated the underlying principles described herein may equally be adopted for different electronic cigarette configurations, for example single-part devices or modular devices comprising more than two parts, refillable devices and single-use disposable devices, as well as devices conforming to other overall shapes, for example based on so-called box-mod high performance devices that typically have a more box-like shape.

The present disclosure relates to an aerosol provision system and device in which a reservoir containing an aerosol precursor material is selectively pressurized via application of a fluid to force at least a portion of the aerosol precursor material from the reservoir, e.g., through an outlet port coupled to the reservoir. The aerosol precursor material is stored within the reservoir in a manner which prevents or substantially reduces the chance of aerosol precursor material leaving the reservoir of its own accord, or in other words, the reservoir is configured to increase the aerosol precursor material retention within the reservoir. For example, the reservoir may include an outlet valve which is actuated to an open position under application of a sufficient force or pressure. In one implementation, the reservoir is provided with an inlet and an outlet valve which act to close off the internal volume of the reservoir when no fluid is applied to the reservoir, thus retaining the liquid within the reservoir to a greater degree. The present disclosure presents implementations in which an aerosol precursor material is sufficiently prevented from exiting the reservoir, thus offering the potential benefits of improved hygiene for both the user handling the device and microbial growth, as well as a reduction in the presence of off-tastes or the like from aerosol precursor material that is not aerosolised or not aerosolised fully and influences the generated aerosol.

Figure 2:
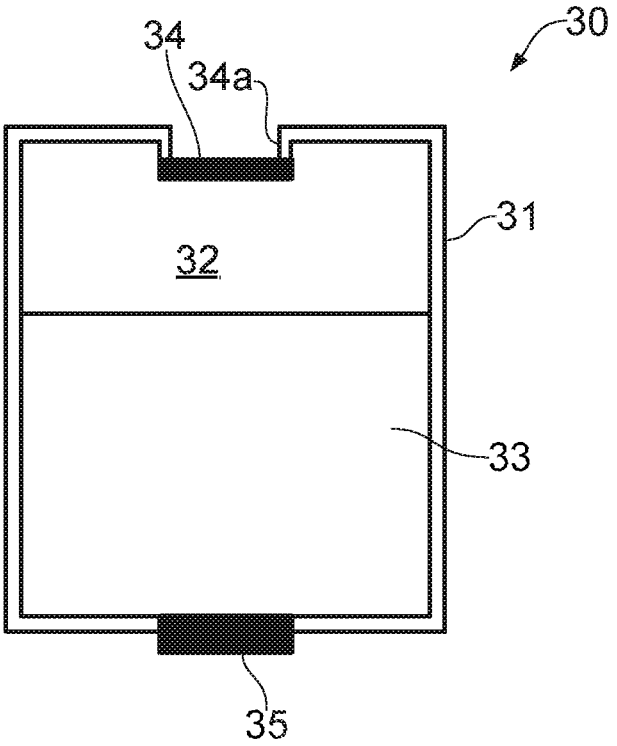
FIG. 2 schematically represents the cartridge part of the aerosol provision system of FIG. 1 in more detail, and specifically in cross-section.
Figure 3:
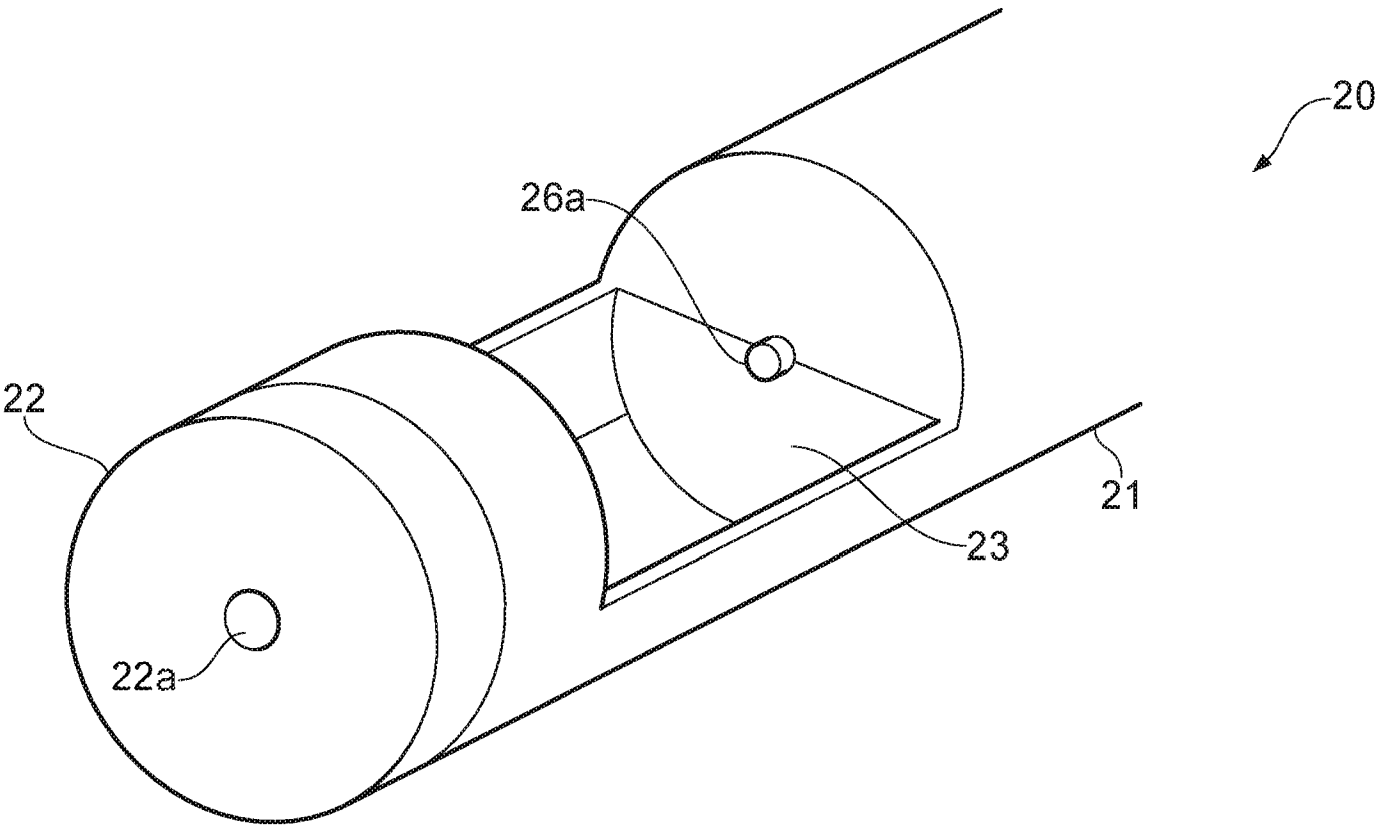
FIG. 3 schematically represents the reusable device part of the aerosol provision system of FIG. 1 in more detail, and specifically without the cartridge part present.

FIGS. 1 to 3 are schematic diagrams illustrating aspects of an aerosol provision system 10 in accordance with aspects of the present disclosure. The aerosol provision system 10 comprises an aerosol provision device part 20 (herein device part 20 for brevity) and a cartridge part 30 (seen more clearly in FIG. 2). The device part 20 may also be referred to herein as a "control unit" or a "reusable part", and these terms are to be considered interchangeable with "device part" herein. The cartridge part 30 is arranged to removably couple to the device part 20, as described in more detail below.

FIG. 1 shows a schematic cross-sectional view of the cartridge part 30 coupled to the device part 20, which is a configuration in which a user would typically use the aerosol provision system 10 to generate aerosol. FIG. 2 schematically shows a cross-sectional view of the cartridge part 30 in isolation of the device part 20. FIG. 3 shows a perspective view of a section of the device part 20 with the cartridge part 30 decoupled from the device part 20. Note that various components and details, e.g. such as wiring and more complex shaping, have been omitted from FIGS. 1 to 3 for reasons of clarity.

The cartridge part 30 includes a reservoir 32 containing an aerosol precursor material. In this specific implementation, the aerosol precursor material is a liquid aerosol precursor material (sometimes referred to as a source liquid). The source liquid may contain nicotine or other active ingredients, or a one or more flavors. As used herein, the terms "flavor" and "flavorant" refer to materials which, where local regulations permit, may be used to create a desired taste or aroma in a product for adult consumers. The source liquid may also comprise other components, such as propylene glycol or glycerol. As should be appreciated, the cartridge part 30 contains the source liquid which is to be aerosolised for user inhalation.

The device part 20 includes an outer housing 21, a mouthpiece 22 through which generated aerosol can exit the device part 20, a receptacle 23 for receiving the cartridge part 30, a power source 24, control circuity 25, a pressurized fluid generator 26, and an atomizer 27.

The device part 20 includes an outer housing 21 which may be formed from a plastics or metal material, for example. The outer housing 21 has a generally cylindrical shape, extending along a longitudinal axis indicated by dashed line LA, and correspondingly has a generally circular cross-sectional shape when viewed along the longitudinal axis LA. The cartridge part 30 also has a generally cylindrical shape which extends along a central axis of the cartridge part (not shown). It should be appreciated, however, that in other implementations the shape and/or cross sectional shape of the device part 20 and/or cartridge part 30 may be different, having shapes such as elliptical, square, rectangular, hexagonal, or some other regular or irregular shape as desired.

The outer housing 21 includes a mouthpiece 22 at one end of the device part 20 which further includes an opening 22*a* through which generated aerosol can be inhaled by the user. The mouthpiece 22 is integrally formed with the housing 21 of the device part 20, although in other implementations the mouthpiece 22 may be removably coupled to the housing 21 via a suitable mechanism, e.g., a screw thread or push fit, to allow changing of the mouthpiece for hygiene reasons. The mouthpiece 22 defines an end of the device part 20 which is inserted into, or otherwise brought into close proximity with, the user's mouth during normal usage of the system 10. The mouthpiece end of the device part 20 may also be referred to as a proximal end. Correspondingly, the end opposite the proximal end may be referred to as the distal end of the device part 20. The outer housing 21 also includes a side surface between the proximal and distal ends of the device part 20 which, in normal use, is the surface that the user holds with their hand, for example.

The device part 20 generally includes components with operating lifetimes longer than the expected lifetime of the replaceable cartridge part 30, which may be defined by the amount of source liquid present in the reservoir 32. The device part 20 is intended to be used with multiple cartridge parts 30, and hence the device part 20 is said to be reusable. With reference to FIGS. 1 and 3, the housing 21 includes a receptacle 23 which is sized to receive the cartridge part 30. The receptacle defines a location at which the cartridge part 30 is coupled to the device part 20. The receptacle 23 is positioned between the distal and proximal ends of the device part 20. In FIG. 1, the gap between the cartridge part 30 and the inner wall of the receptacle 23 is emphasised for the purposes of clarity, however in practical implementations the receptacle 23/cartridge part 30 are sized such that cartridge part 30 fits snuggly into the receptacle 23. The reusable device part 20 and cartridge part 30 are separable/detachable from one another by pulling the cartridge part 30 out of the device part 20 in a direction broadly perpendicular to the longitudinal axis LA. When the cartridge part 30 is coupled to the device part 20, as broadly indicated by FIG. 1, the central axis of the cartridge part 30 aligns with the longitudinal axis LA of the device part 20, although in other implementations the axes may be offset from one another.

As seen in FIG. 3, the receptacle 23 of the present implementation can be broadly thought of as a hemi-cylindrical cut-away (e.g., a hemi-cylindrical section void of any part of the outer housing) below which is positioned a hemi-cylindrical recess extending into the device part 20. The two hemi-cylindrical sections provide a cradle configuration and define a substantially cylindrical volume into which the cylindrical cartridge part 30 can be placed. In this implementation, half of the cylindrical cartridge part 30 fits into the hemi-cylindrical recess and is covered by the outer housing 21, while the other half of the cartridge part 30 is exposed. The receptacle 23 and/or cartridge part 30 may be shaped such that the outer surface of the cartridge part 30 and broadly aligns with the outer surface of the housing 21.

The cartridge part 30 is inserted into the receptacle 23 by pushing the cartridge part 30 in a direction towards the longitudinal axis LA, and is removed from the receptacle 23 by pulling the cartridge part 30 in a direction away from the longitudinal axis LA. To facilitate removal of the cartridge part 30, the cartridge part 30 and/or outer housing 21 may have features that enable a user to grip the cartridge part 30. For example, a protrusion or recess may be placed on the outer surface of the cartridge part 30. The housing 21 or cartridge part 30 may also be provided with a locking mechanism (not shown) which can be used to retain, or help retain, the cartridge part 30 in the receptacle 23. Alternatively or additionally, a lid hinged on the device part 20 may be provided to cover the exposed part of the cartridge part 30 to retain, or help retain, the cartridge part 30 within the receptacle 23.

The cartridge part 30 is detached from the reusable device part 20 for replacement of the cartridge part 30 when the supply of source liquid is exhausted or if the user wishes to change the flavor/type of source liquid, and is replaced with another cartridge part 30, if so desired.

The reusable device part 20 further includes a power source 24, such as a battery or cell (e.g., a lithium ion battery) to provide power to the aerosol provision system 10. The battery may be rechargeable and/or replaceable. It should be appreciated that any suitable battery may be installed within the reusable device part 20.

The control circuitry 25 includes a circuit board to provide control functionality for the aerosol provision device, e.g. by provision of a (micro) controller, processor, ASIC or similar form of control chip. The control circuitry 25 may be arranged to control any functionality associated with the system 10, including operation of the atomizer 27 and of the pressurized fluid generator 26 which are explained in more detail below. However, the control circuitry 25 may also control charging or re-charging of the battery 24, visual indicators (e.g., LEDs)/displays associated with operational states/status of the device part 20, or communication functionality for communicating with external devices, etc. The control circuity 25 may be comprised of a printed circuit board (PCB). Note also that the functionality provided by the control circuitry 25 may be split across multiple circuit boards and/or across components which are not mounted to a PCB, and these additional components and/or PCBs can be located as appropriate within the aerosol provision device. For example, functionality of the control circuitry 25 for controlling the (re)charging of the battery 24 may be provided separately (e.g. on a different PCB) from the functionality for controlling the discharge.

The pressurized fluid generator 26 is a component capable of generating a pressurized fluid from an initial fluid. In other words, the pressurized fluid generator 26 is able to increase the pressure of a fluid at a first pressure up to a second pressure. In the implementation described, the pressurized fluid generator 26 is an air compressor 26 and is thus capable of generating pressurized air. The air compressor 26 is in fluid communication with the environment external to the device part 20 via one or more air compressor inlets **26*b*, which may be an aperture located on the outer housing 21 and fluidly coupled to an inlet of the air compressor 26. In operation, the air compressor 26 is able to draw in air from outside the device part 20 via inlet 26*b* and generate a pressurized fluid (more specifically pressurized air) having a greater pressure than the environmental air. Although the pressurized fluid generator 26 is shown at a specific location in FIG. 1, it should be understood the generator 26 could be located at any suitable location within the device part 20 and piping or the like can be used to suitably connect the generator to the cartridge part 30** (described in more detail below).

Any suitable air compressor 26 can be used in accordance with principles of the present disclosure. For example, in one embodiment, the air compressor 26 is a piezo-electric pump. The pressure to which the air compressor 26 raises the air to may vary from implementation to implementation depending on the properties of the cartridge part 30 (discussed in more detail below). In the implementation described the pressure of the pressurized air output from the air compressor is between 100 to 600 mBar, although this value may depend on the operating frequency of the piezo-electric pump and the desired output flow-rate.

The atomizer 27 is any component which is capable of generating an aerosol from an aerosol precursor material. The atomizer 27 may include a resistively heated element, an inductively heated element, a vibrating mesh, an irradiative heat source, a chemical substance, etc. The choice and suitability of the atomizer 27 may depend upon the aerosol precursor material that is to be aerosolised. By way of a concrete example, in the implementation described, the atomizer is a heating element 27 that comprises a non-electrically conductive substrate (such as a ceramic) and an electrically conductive material (such as NiChrome) that is heated when an electric current is passed through the material. The heating element 27 takes the form of a (rectangular) planar plate. The electrically conductive material is resistively heated (e.g., via application of electrical power from the battery 24). The heating element 27 is suitable for reaching temperatures capable of vaporising the source liquid to generate an aerosol, e.g. in the range of 150 to 350° C. The temperature of the heating element 27 may also be controlled to achieve and/or maintain a certain temperature, in certain implementations. Although not shown in FIG. 1, the device part 30 may optionally include a heating element temperature sensor, such as a resistance temperature detector (RTD), configured to sense a temperature of the heating element 27. In these implementations, the control circuitry 25 is able to control the power supplied to the heating element 27 to achieve or maintain a certain temperature, based on the sensed temperature of the heating element 27. In other implementations, however, the temperature of the heating element 27 may be obtained without using a separate temperature sensor, e.g., via the control circuitry 25 being configured to determine the electrical resistance of the heating element 27.

With reference to FIGS. 1 and 2, the cartridge part 30 includes an outer housing 31, a reservoir 32 defined by the inner surfaces of the outer housing 31, source liquid 33 within the reservoir 32, an inlet port 34 and an outlet port 35.

The outer housing 31 of the cartridge part 30 is arranged such that a hollow region within the outer housing 31 is present. The hollow region defines the reservoir 32 of the cartridge and provides a volume configured to store a quantity of source liquid 33, e.g., up to 2 ml of source liquid. The source liquid 33 is provided free in the implementation described, meaning that the source liquid 33 is held predominantly only by the inner surfaces of the outer housing 31 and is otherwise free to move within the reservoir 32. However, in other implementations, the reservoir 32 may include, for example, a cotton or foam soaked in the source liquid 33.

The inlet port 34 and outlet port 35 define an inlet and outlet to the cartridge part 30. The inlet and outlet ports 34, 35 are fluidly coupled to the reservoir 32, and thus provide an inlet and an outlet of the reservoir 32, respectively. The inlet port 34 is arranged such that when cartridge part 30 coupled to the device part 20, e.g., when placed in the receptacle 23, the inlet port 34 is additionally brought into fluid communication with the air compressor 26 via a pressurized fluid passage **26*a*. The pressurized fluid passage 26*a* is a channel fluidly coupling an outlet of the air compressor 26 with the receptacle 23 (and inlet port 34 when the cartridge part 30 is installed in the receptacle 23). Thus, pressurized air generated by the air compressor 26 is able to pass to the inlet port 34 of the cartridge part 30 via the pressurized fluid passage 26*a***.

When the pressurized fluid passage **26*a* and cartridge part 30 are coupled together (e.g., when the cartridge part 30 is inserted in the receptacle 32), pressurized air is directed along the fluid passage 26*a* to the inlet port 34. In this regard, the pressurized fluid passage 26*a* and cartridge part 30 (or rather the mating between pressurized fluid passage 26*a* and cartridge part 30) are configured to prevent or reduce leakage of pressurized air from the pressurized fluid passage 26*a*. In other words, the pressurized fluid passage 26*a* is engaged with the cartridge part 30 and/or the inlet port 34 to form an air-tight (or substantially air-tight) seal. In the implementation shown in FIG. 1 and more prominently in FIGS. 2 and 3, the pressurized fluid passage 26*a* extends slightly into the receptacle 23. The extended part of the pressurized fluid passage 26*a* is arranged to fit within a recessed section 34*a* of the cartridge part 30, thereby forming a seal. The recessed section 34*a* and/or the exposed part of the pressurized fluid passage 26*a* may optionally comprise a sealing element, such as an O-ring or the like to aid in creating the air-tight seal. To facilitate inserting the exposed part of the pressurized fluid passage 26***a* into the recessed section 34*a*, one or both of the pressurized fluid passage 26*a* and the recessed section 34*a* are formed of flexible material (such as an elastomer) and/or the receptacle 23 is sized slightly longer than the length of cartridge part 30 to enable the user to insert the cartridge part 30 into the receptacle 23 and then push (in a direction along the longitudinal axis LA) the recessed section 34*a* of the cartridge part 30 onto the exposed part of the pressurized fluid passage 26*a*. It should be appreciated that this is one example of how an air tight, or substantially air tight, mating between the cartridge part 30 and pressurized fluid passage 26*a* can be achieved. In other implementations, a recess may be formed in the receptacle 23 and the input port 34 may be arranged to extend into the recess of the receptacle 23. Alternatively, the cartridge part 30 may be provided with another coupling mechanism, such as a screw thread or the like for coupling to a corresponding thread in the device part 20.

When the cartridge part 30 is coupled to the device part 20, the outlet port 35 is arranged in the proximity of the heating element 27. Source liquid 33 is able to pass from the outlet port 35 (as described in more detail below), and towards the heating element 27. In this way, the source liquid 33 is able to be heated after exiting the cartridge part 30, and subsequently form an aerosol with air entering the device at air inlet 28. Although not shown, a guide element (such as a hollow cylindrical tube) may be provided to help guide the source liquid 33 ejected from the cartridge part 30 towards the heater element 27.

The inlet and outlet ports 34, 35 of the implementation described include respective valves, as shown more clearly in FIG. 3. The valves are configured to be biased to a closed/sealed (at least liquid tight) configuration, and are therefore arranged to open in response to a certain threshold pressure being applied to the respective valve. Strictly speaking, the threshold pressure at which the valve is arranged to open is in fact a threshold pressure differential relative to the environmental pressure outside of the reservoir 32. Accordingly, the cartridge part 30 is liquid tight when removed from the device part 20, thus meaning that the chance for source liquid 33 to leak from the cartridge part 30 is low.

It should be appreciated, however, that in other implementations one or more of the inlet and outlet valves are not present, and instead the inlet and outlet ports 34, 35 may always be open. In these implementations, the liquid-tight sealing configuration is provided by careful consideration of the aperture size (e.g., diameter) of the inlet or outlet ports relative to the source liquid 33, whereby the surface tension of the source liquid 33 is used to prevent the source liquid 33 from exiting the cartridge part 30 below a certain threshold pressure. In this case, when the pressure exceeds the point at which the surface tension can no longer hold the liquid, the liquid is ejected from the outlet port 35.

With reference back to FIG. 1, the arrangement of the cartridge part 30 and the components of the device part 20 is such that the compressed air generated by the compressor 26 is forced into the side of the reservoir 32 of cartridge part 30 closest to the mouthpiece 22. That is, the inlet 34 is generally closer to the mouthpiece 22 than the outlet 35. Generally speaking, during normal use of the aerosol provision system 10, the user holds the system such that the mouthpiece 22 is located in or in close proximity to the user's mouth, while the distal end (e.g., the end opposite the mouthpiece 22) is held slightly lower down than the mouthpiece end. That is, the device in normal use is held at an incline with the mouthpiece end elevated above the distal end. This means that the liquid in the reservoir 32 tends to be located closer to the outlet 35. Subsequently, this arrangement helps reduce the chances of air being forced out of outlet 35 as, in normal use, there is a volume of liquid in contact with the outlet 35. It should be appreciated that the outlet 35 and inlet 34 may be located at various positions within the cartridge part 30 (e.g., offset in the axial direction) to help improve this effect.

The operation of such an aerosol provision system 10 is now described with reference to FIG. 4. Firstly, if not already done so, the user installs a cartridge part 30 containing source liquid 33 in the receptacle 23 of the device part 20 (step S1). As mentioned, in the described implementation, this involves inserting the cartridge part 30 by pushing the cartridge part 30 towards the axis LA of the device part 20 so that the axis of the cartridge part 30 aligns with the axis LA of the device part 20.

Then, at step S2, the user powers on the aerosol provision system 10. In this regard, the housing 21 includes a button or other actuation mechanism for transitioning the device part 20 from an OFF mode to an ON mode, at which point power from the power source 24 is supplied to the control circuitry 25. Note that in some implementations a small amount of power may be supplied to the control circuitry 25 even when the device part 20 is switched OFF; however at step S2 a greater power is supplied enabling more functions of the control circuitry 25 to be provided with power.

At step S3, the device part 20 monitors for a user action. The user action is one which signifies that the user wants to inhale aerosol. For example, the action might be actuating a button or the like on the surface of the housing 21. For example, the user may push the button and then bring the mouthpiece 22 to their lips and begin inhaling. Alternatively, the action might be based on the user actually inhaling on the mouthpiece 22. For example, the device part 20 may include a pressure or airflow sensor (not shown) configured to detect when a user is inhaling on the device part 20. If any of the above user actions are detected, the method proceeds to step S4, otherwise the device part 20 continues to monitor for a user action.

Once a user action has been detected at step S3, the control circuity 25 then supplies power to the air compressor 26 to begin generating pressurized fluid (air) at step S4. In this regard, the control circuitry 25 controls, for example, a motor of the air compressor 26 by supplying a certain power from the battery 24 to generate pressurized air. At step S5, the generated air is applied (or supplied) to the inlet port 34 of the cartridge part 30 via the pressurized fluid passage 26*a*. When the pressurized air is applied to the inlet port, and when the pressure is sufficient to overcome the threshold of the valve of the inlet port 34, the valve of the inlet port 34 is opened (and thus exposes the reservoir 32).

It should be appreciated that although steps S4 and S5 are shown as separate steps, they may in fact be implemented at substantially the same time. An air compressor operates by forcing air into an enclosed volume and gradually building up the pressure of the air within that volume. The enclosed volume may be a separate storage volume (e.g., which is formed as part of the air compressor 26) or may the volume formed by the compressed fluid passage 26*a* and the (closed) inlet port 34.

Accordingly, in cases where the compressed air is stored within the compressor 26 or is separate to the passage 26*a*, the release of the compressed air can be controlled (e.g., by the control circuitry 25). For example, once the pressure within the storage volume reaches a certain limit, the control circuitry 25 can be configured to release the compressed air (which subsequently travels along the passage 26) by opening a valve. Alternatively, the air compressor 26 may continually supply air to the passage 26*a* which gradually increases the pressure within the passage 26*a*, and hence steps S4 and S5 occur substantially simultaneously. In this case, the air pressure within passage 26*a* may gradually increase until the time at which the valve of the inlet port 34 opens (and at which time the compressed air can enter the reservoir 32).

It should be appreciated that the air compressor 26 may have certain operational parameters that can determine how the pressure within the reservoir is changed. For example, an air compressor 26 can be characterised by an output flow rate, e.g., X ml of air per second. Depending on the value of X, the pressure threshold of the valve of the input port 34, and of the additional "empty" volume defined by the reservoir, the valve of the input port 34 can either effectively remain open or can close (until such a time as the pressure has built up enough to force the valve of the input port 34 open again). For the sake of providing a concrete example, it is assumed in the present implementation that the valve of the input port 34 remains open.

Figure 5:
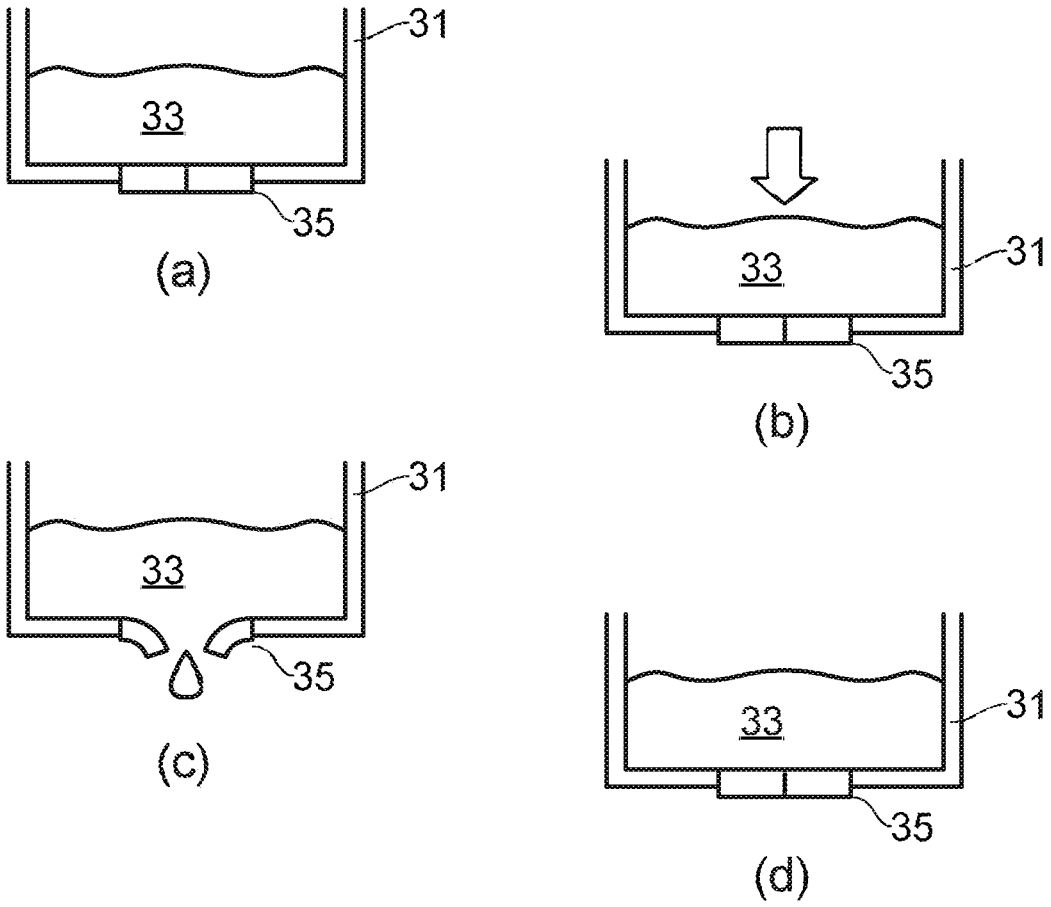
FIGS. 5*a* to 5*d* schematically show the cartridge part of the aerosol provision system of FIG. 1 at various times during the operation of the aerosol provision system.
Figure 6:
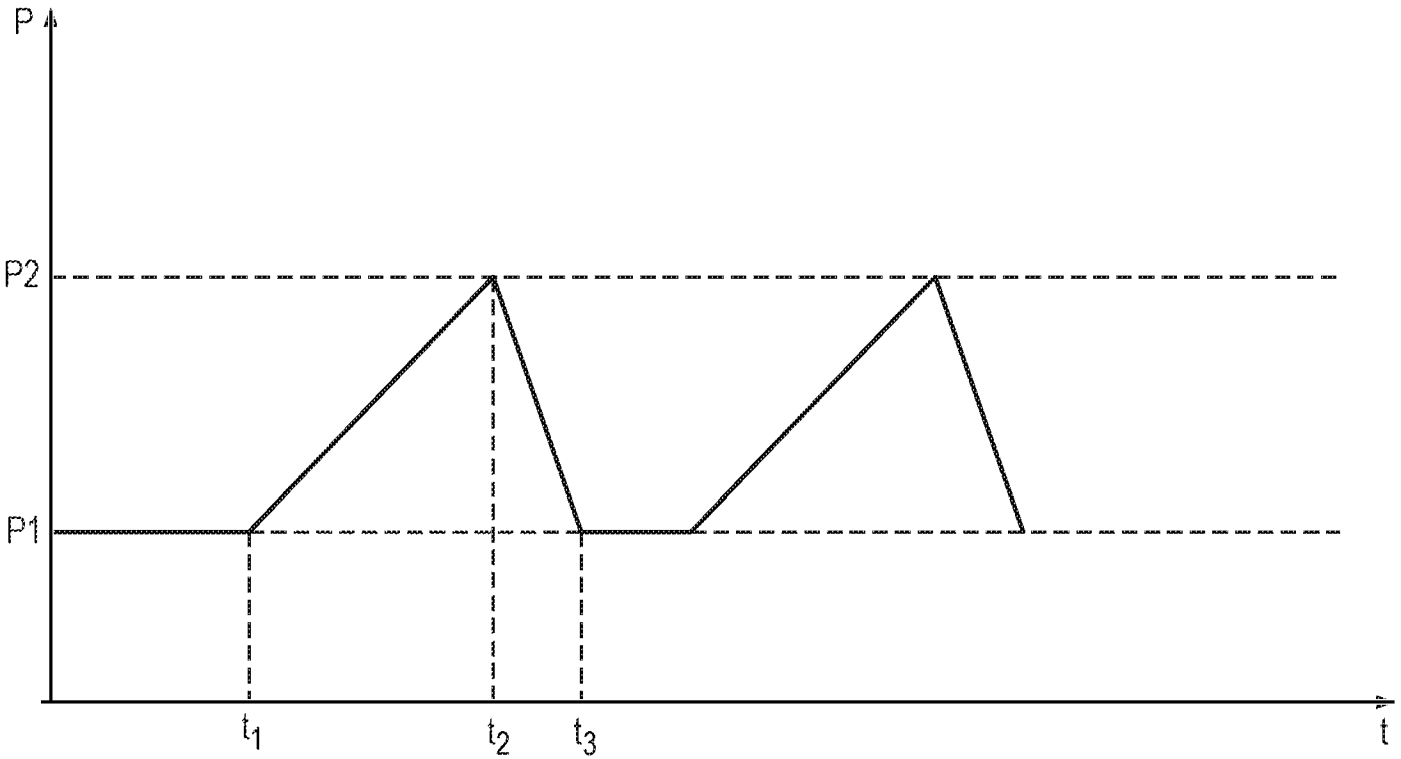
FIG. 6 shows a graph representative of the value of pressure within the reservoir of the cartridge part of the aerosol provision system of FIG. 1 (y-axis) with respect to time (x-axis) during operation of the aerosol provision system.

Turning to FIGS. 5 and 6, it is now explained what happens when a compressed fluid (e.g., compressed air) is applied to the reservoir 32 containing source liquid 33. FIGS. 5(*a*) to 5(*d*) show a cross-section of the cartridge part 30 (and specifically the outlet port 35) at various stages in the cycle of applying pressure to the reservoir 32, while FIG. 6 is a graph showing pressure P in the reservoir 32 on the y-axis and time t on the x-axis.

FIG. 5(*a*) shows the cartridge part 32 when no pressurized fluid is applied to the reservoir 32. In this state, the valve of the outlet port 35 is closed. The pressure within the reservoir 32 is at a first pressure P1. This state is represented in FIG. 6 from t=0 to $t=t_1$, which shows a constant pressure P1 within the reservoir 32. As described above, this is the state prior to which the valve of the inlet port 34 is open, and thus it should be appreciated that the air compressor 26 may be running in the period up to $t_1$ and compressed fluid may be being applied to the valve of the input port 34 between $t_0$ and $t_1$.

At time $t_1$, the inlet valve of the inlet port 34 is opened by the compressed fluid (air) from the air compressor 26. At this point, compressed air can begin entering the reservoir 32. This is shown by the arrow in FIG. 5(*b*). At time $t_1$, the pressure within the reservoir begins to increase (as indicated by the inclined line in FIG. 6 after $t_1$).

At a certain point in time, $t_2$, the pressure within the reservoir 32 is large enough to cause the outlet valve of the outlet port 35 to open. In other words, there exits a differential pressure between the inside of the reservoir and the external environment of the valve of the outlet port 35 to cause the valve of the outlet port 35 to open. In FIG. 6, this is represented as pressure P2. Hence, when the pressure within the reservoir 32 reaches pressure P2, the outlet valve of the outlet port 35 opens and, in doing so, a portion of the contents of the reservoir 32 (e.g., a portion of the source liquid 33) is permitted to escape from the reservoir 32. FIG. 5(*c*) shows such a scenario where a droplet of source liquid 33 escapes from (exits) the reservoir 32.

At this time, the pressure within the reservoir 32 decreases. One can rationalise this using the ideal gas equation PV=nRT, under the assumptions that air acts as an ideal gas, that the temperature of the air does not change during this process, and that the source liquid 33 is incompressible. In the ideal gas equation, P represents pressure, V represents the volume of the container the ideal gas occupies, n represents the number of moles of the ideal gas, R is the gas constant, and T is the temperature of the ideal gas. Under the above assumptions, it should be clear that RT is a constant. Shortly before and shortly after the moment at which the source liquid is ejected from the reservoir 32, we can assume that the number of moles of air within the reservoir is reasonably constant (in other words, n is constant). This means that PV is equal to a constant value. As mentioned, some of the source liquid 33 is ejected from the reservoir 32. This ejected source liquid has a certain volume. When the source liquid is ejected, the volume within the reservoir 32 that air can occupy has increased (by an amount proportional to the volume of the ejected source liquid—assuming the source liquid is relatively incompressible, the amount of increase is equal to the volume of the source liquid). This implies that the pressure within the reservoir 32 decreases in order to maintain the constant value nRT.

In FIG. 6, the pressure decreases from pressure P2 to P1 from time $t_2$ to time $t_3$. The period between $t_2$ and $t_3$ is shown exaggerated in FIG. 6 for clarity. In practical applications, $t_3$ is likely much closer to $t_2$. It should also be appreciated that while FIG. 6 shows the pressure going to P1 at time $t_3$, this may not necessarily be the case as the pressure may be slightly above P1 depending on the output flow rate of the air compressor 26 (e.g., the rate at which moles of the gas are entering the reservoir).

As a result of the pressure within the reservoir 32 decreasing, the outlet valve of the outlet port 35 is biased to the closed position, thus stopping additional source liquid 33 from exiting the reservoir 32. This is shown in FIG. 5(*d*).

Hence, it can be seen that the pressure within the cartridge part 30 of the present disclosure starts at a first pressure, increases to a second pressure due to the presence of a pressurized fluid in the reservoir 32, and falls back to a lower pressure once a part of the contents of the reservoir 32 has been ejected from the reservoir 32.

This cycle may be repeated multiple times. Depending upon the amount of source liquid 33 that exits the reservoir 32 in each cycle, each cycle described above may be suitable for one puff/one inhalation on the device part 20, or it may be that multiple cycles are required for a single puff. The latter case offers finer control on the amount of aerosol that can be generated per puff. In other words, the system 10 can be set to control the amount of aerosol generating material that is ejected per second from the cartridge part 30. It should also be appreciated that the former or latter case can be realised by changing the parameters of the components of the device part 20 and the cartridge part 30. The volume of source liquid that exits the cartridge part 30 may be dependent on a variety of parameters, including the geometry of the outlet port, the characteristics of the valve, characteristics of the reservoir, etc. Moreover, the amount of source liquid 33 ejected per second is dependent on the output flow rate of the air compressor, and in some implementations, the control circuitry 25 is configured to control the amount of liquid exiting the cartridge part 30 by adjusting the output flow rate of the air compressor 26 (or more generally the flow rate of pressurized fluid into the reservoir 32). The flow rate may be adjusted based on a user input, such as an instruction to provide a certain amount of aerosol generating material or in response to the characteristics of a user's inhalation.

Turning back to FIG. 4, after steps S4 and S5, the method proceeds to step S6 where the control circuitry 25 supplies power to the atomizer 27. More specifically, the control circuitry 25 supplies power to the resistive element(s) of the heating element 27 causing the resistive element(s) to heat up. The control circuitry 25 is configured to cause the heating element 27 to reach a temperature suitable for vaporising the source liquid 33 that exits the reservoir 32. As mentioned, this may be in the range of 150° C. to 350° C. depending upon the source liquid 33 to be vaporised. The source liquid 33 that has left the reservoir 32 is subsequently vaporised by the heating element 27.

It should be appreciated that while steps S4, S5 and S6 are described in sequence, the steps may be implemented in any order. In some instances, the heating element 27 may be provided with power before the source liquid 33 is ejected from the reservoir 32. This may be the case if the heating element 27 requires a certain time to reach an operational temperature (in other words to accommodate for a thermal lag). Equally, step S5 may be implemented after step S6, again if both the air compressor 26 and heating element 27 require a certain time to reach an operational condition.

When the user inhales on the mouthpiece 22 of the device part 20, air is drawn into the device part 20 via air inlet 28 positioned on the device part housing 21. The air path is arranged to pass via the heating element 27. The air path is shown in FIG. 1 via the series of arrows starting at the inlet 28. Hence, when the source liquid 33 is vaporised by the heating element 27 as described above, air mixes with the generated vapor from the heating element 27 to form an aerosol. The sucking action of the user means that the aerosol is then passed through the device part 20 to the opening 22*a* of the mouthpiece 22 where it is then passed to the mouth/lungs of the user.

At step S7, the control circuitry 25 continues to monitor for the presence of the user action as detected at step S3. If the action is maintained, then the process continues as discussed above (which may include performing another cycle of steps S4 to S6 as described above). In the event that the user action is not maintained, the method proceeds to step S8, where the power may be stopped to one of the air compressor 26 and/or the heating element 27. The method then proceeds to step S3 and the cycle is repeated for a subsequent user action.

Figure 4:
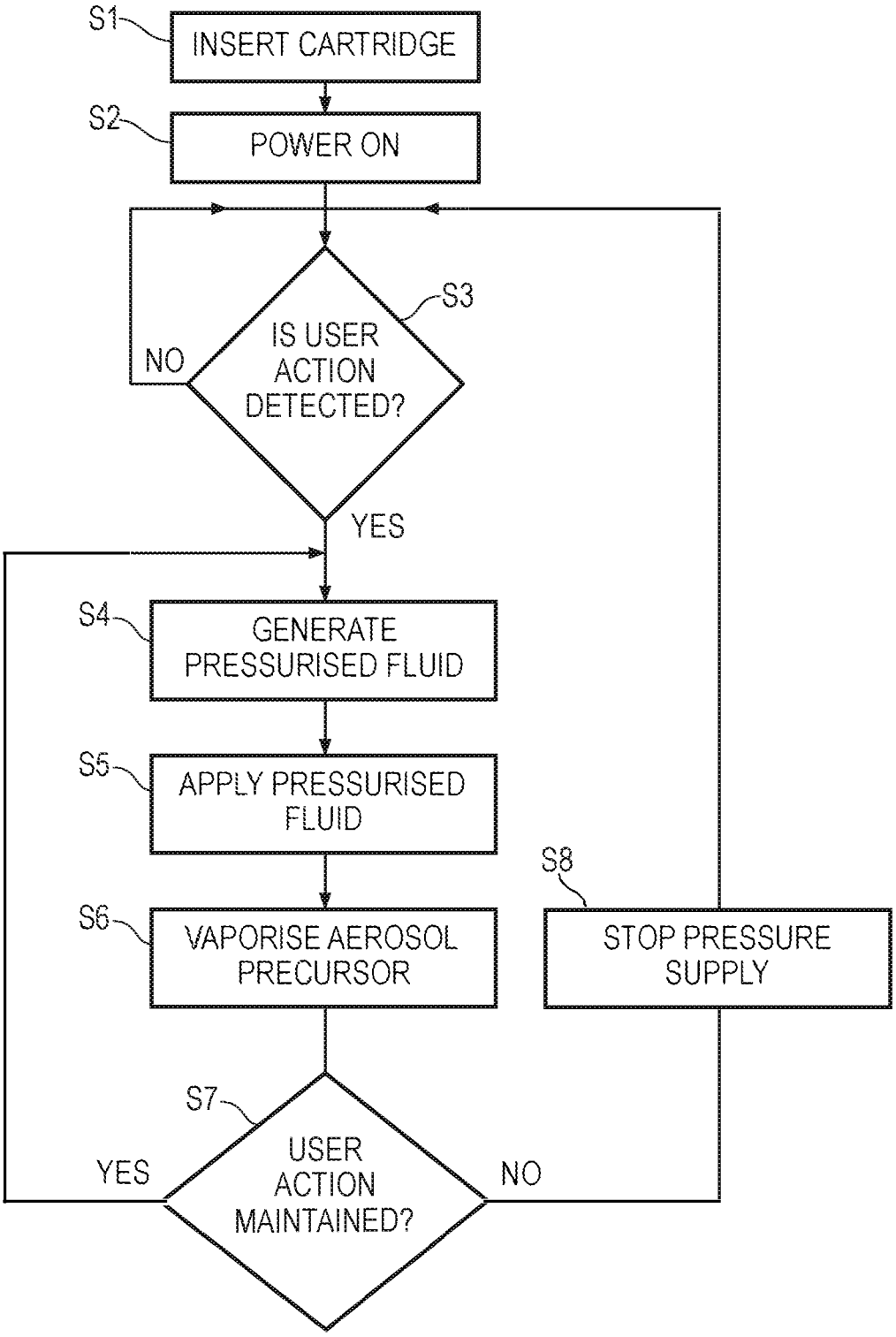
FIG. 4 shows a flow diagram of an example method of operation of the aerosol provision system of FIG. 1.

It should be appreciated that the method shown in FIG. 4 is exemplary only and the device may operate according to a method modified from that shown in FIG. 4, as hinted at above. Hence, according to the application at hand, the components used in the device or the user's preferences, the device can be configured or set-up accordingly.

The pressurized fluid generator 26 as described above may, more generally, be referred to as a source of pressurized fluid. That is, the "source of pressurized fluid" as used herein is considered to include mechanisms not only where pressurized fluid is generated from an initial (non-pressurized or low-pressurized) fluid as described above, but also includes sources of stored pre-pressurized (i.e., already pressurized) fluid, for example in the form of a compressed air canister or the like.

Figure 7:
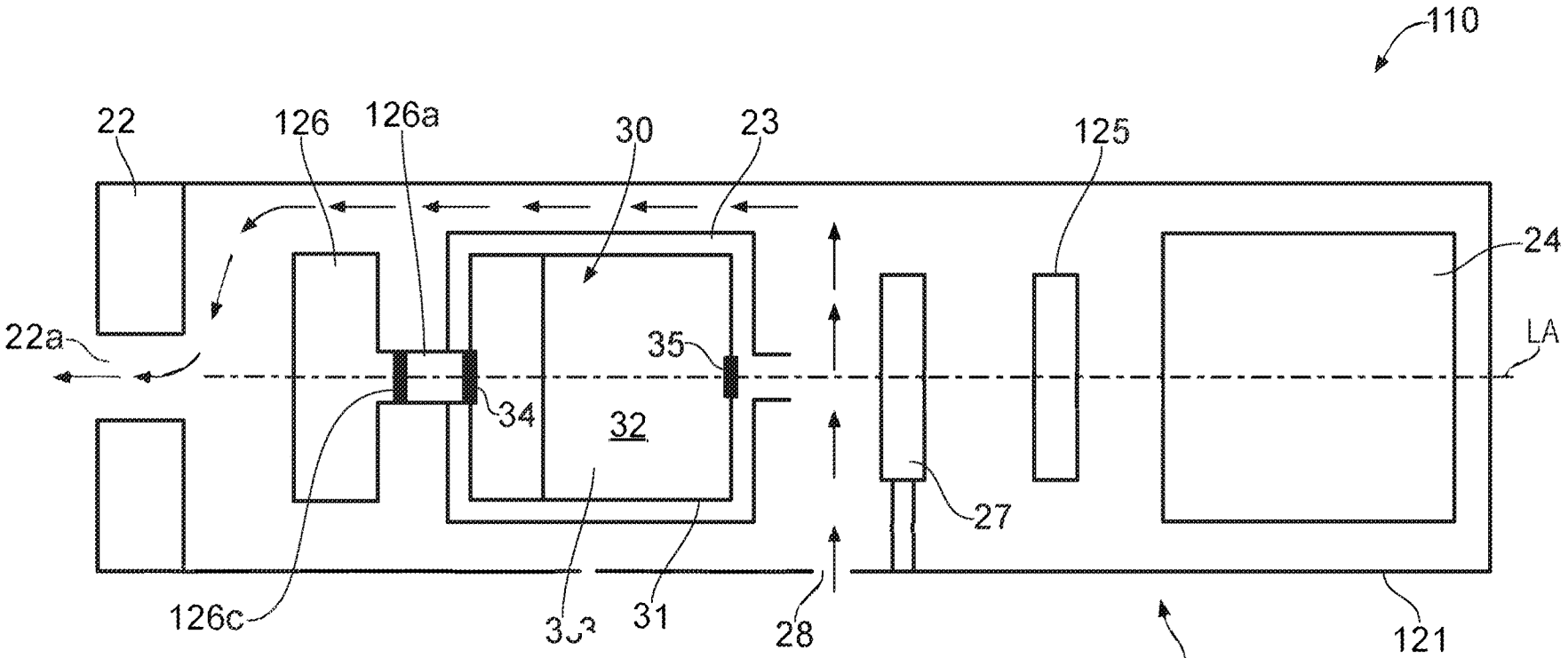
FIG. 7 schematically represents an alternative implementation of an aerosol provision system in accordance with the principles of this disclosure which includes a device part having a pressurized fluid source for controlling the flow of a liquid or other suitable aerosol precursor material from a reservoir of a cartridge part using pressurized fluid source.

FIG. 7 shows a schematic cross-sectional view of an aerosol provision system 110 including a store of pressured fluid. The system 110 of FIG. 7 includes many components that are similar or identical to those described with respect to FIG. 1. These components are indicated with the same reference signs as used in relation to FIG. 1, and hence a repeat of the description of these components is not presented herein for brevity.

The device part 120 of the aerosol provision system 110 differs from the device part 20 of aerosol provision system 10 of FIG. 1 in that it includes a store of pressurized fluid 126 and control circuitry 125 suitable for controlling the release of pressurized fluid to the cartridge part 30 (which is largely identical to the cartridge part 30 described in FIG. 1), as opposed to an air compressor 26 and control circuitry 25.

More specifically, the device part 120 comprises a store of pressurized fluid 126, which in this example includes a compressed air canister. However, it should be understood that any suitable container for housing a pressurized fluid of any description could be used in accordance with the principles of the present disclosure. The store of pressurized fluid is pre-pressurized before being installed in the device part 120, for instance using known techniques for filling containers for holding pressurized fluid. Hence, the store of pressurized fluid may also herein be referred to as a pre-pressurized store of fluid. The pre-pressurized store of fluid may be separable from the device part 120 in a similar manner as cartridge part 30 is separable from device part 120. Hence, the pre-pressurized store is able to be removed and replaced with another pre-pressurized store, in the event that the pressurized fluid runs out or the pressure becomes too low to enable actuation of the inlet valve of the inlet port 34. The control circuitry 125 may be provided with the functionality to identify when the pre-pressurized store is running low, for example by monitoring the pressure of the fluid released from the pre-pressurized store using a suitable sensor (not shown) or by recording the usage of the pre-pressurized store.

The device part 120 further comprises a pressurized fluid passage 126*a* which is largely similar to the fluid passage 26*a* described in relation to FIG. 1. However, the fluid passage 126*a* in this example further includes a release element 126*c*. The release element 126*c* is an actuatable member that is configured to selectively block the fluid passage 126*a*. The release element 126*c* may be biased to the blocked position. The release element 126*c* is controllable by the control circuitry 125. More specifically, when the user action is detected at step S3 of FIG. 4, the control circuitry 125 is configured to actuate the release element 126*c* causing the passage 126*a* to be open. In the blocked state, the release element 126*c* prevents (or substantially reduces) the flow of pre-pressurized fluid from the store 126 to the inlet port 34. However in the open state, the pre-pressurized fluid is able to escape from the store 126 and pass along to the inlet port 34. The release element 126*c* may employ any suitable technology that can be used to selectively allow fluid, such as compressed air, to exit an otherwise sealed container, e.g., such as actuators used on pressurized deodorant or paint cans. It should be appreciated that the release element 126*c* may be located in the device (e.g., as part of the fluid passage 126*a*, as described) or as part of the container forming store 126 (e.g., as part of a nozzle or valve on the container). In the latter case, the store 126 or device part 120 may include an engagement mechanism that enables the release element 126*c* to engage with, and be actuated by, device part 120.

In some implementations, the control circuitry 125 can be configured to control the flow of fluid to the inlet port 34 (and thus to the reservoir 32) based on actuating the release element 126*c* to varying degrees. For example, a slower flow rate can be achieved by only partially opening the actuator. In this way, the control circuitry 125 can be configured to provide dosing control of the source liquid 33 to the heating element 27.

It should also be noted that the housing 121 of device part 120 is largely similar to housing 21 described in relation to FIG. 1. However, because device part 120 includes a pre-pressurized store of fluid 120, there is no necessity for an air inlet 26*b* as descried in relation to FIG. 1 because the pre-pressurized store of fluid does not generate pressurized fluid from outside of the device part 120.

Thus there has been described an aerosol provision system comprising: a reservoir for containing an aerosol precursor material; an inlet port and an outlet port both fluidly connected to the reservoir; and a control unit configured to supply a pressurized fluid to the reservoir via the inlet port to increase the pressure within the reservoir relative to the pressure external to the reservoir to force the aerosol precursor material to exit the reservoir via the outlet port.

Although it has been described above that a device part 20, 120 is configured to supply pressurized air to inlet port 34 of a cartridge part 30, it should be appreciated that other pressurized fluids may be supplied to the cartridge part 30. For instance, other gases may be pressurized and supplied to the cartridge part 30. Alternatively, liquids, such as water or oil, may also be supplied to the cartridge part 30. In implementations where the cartridge part 30 contains a liquid, such as source liquid 33, the liquid to be supplied is preferably not miscible (or immiscible) with the source liquid 33. In this way, the immiscible liquid acts to displace the source liquid 33 from the cartridge part 30. Depending on how the device part 20, 120 is orientated during normal usage, the fluid may be lighter or heavier than the source liquid 33 to ensure that the source liquid is ejected from the cartridge part 30.

Although it has been described above that a device part 20 which includes a pressurized fluid generator (such as air compressor 26) additionally includes an air inlet 26*b* for drawing in air from outside the device part 20 via the inlet 26*b*, this is not always necessary. In some implementations, the pressurized fluid generator 26 is configured to pressurise a liquid, such as water, or a gas which is not air. In these implementations, the water or gas to be pressurized is provided in a store/container which can be integral with or insertable into device part 20 (in a similar way to store 126). However, in these implementations, the pressurized fluid generator 26 is configured to pressurise the fluid stored in the container in response to a user input. This may be advantageous as the container does not need to be pressurized before use (as in the case for device part 120), and so in some cases can be easier for a user to refill or replace.

It has also been described above that cartridge part 30 includes a liquid reservoir containing a source liquid which acts as a vapor/aerosol precursor. However, in other implementations, the cartridge part 30 may contain other forms of aerosol precursor material, such as tobacco leaves, ground tobacco, reconstituted tobacco, gels, etc. In accordance with the principles of the present disclosure described herein, while the degree to which more solid/gel type aerosol precursor materials may exit the cartridge part 30 when the cartridge part 30 is not in a normal orientations may be relatively less, the disclosure nevertheless applies to any form of aerosol precursor materials. That is, the present disclosure relates to non-combustible aerosol provision systems such as heating products that release compounds from substrate materials without burning the substrate materials, such as electronic cigarettes, tobacco heating products, and hybrid systems to generate aerosol from a combination of substrate materials. The substrate materials, sometimes referred to herein as aerosol precursor materials or aerosolizable materials, may include any of a liquid, a gel or a solid substrate.

It should also be understood that cartridge parts 30 may be provided with combinations of aerosol precursor materials. It should be appreciated that any suitable type of vaporisation element/heating element may be selected in accordance with aspects of the present disclosure, e.g., a wick and coil, an oven-type heater, an LED type heater, a vibrator, etc.

It has also generally been described above that the cartridge part 30 does not include a heating element 27 (or more generally a vaporisation element). In some implementations, the cartridge part 30 may include a heating element 27 integrated with the cartridge part 30, with the intention that the heating element 27 is disposed of with the cartridge part 30. In this case, the cartridge part 30 may include electrical connections for electrically connecting the heating element 27 to the power source 24 of the device part 20.

In other implementations, the cartridge part 30 may be omitted and instead the device part 20 may be provided with an aerosol precursor material reservoir which can receive a quantity of aerosol precursor material directly. For example, the device part may include a reservoir having a removable cap (e.g., a threadingly engaged cap) which enables source liquid to be inserted into the device part 20. (Or an alternative way to view such implementations is that the cartridge part 30 is integrated with the device part 20). The present disclosure also applies to such vapor provision systems 10.

Although it has been described above that the receptacle 23 forms a cradle-like recess, it should be appreciated that other mechanisms for housing the cartridge part 30 may be implemented instead. For example, the housing 21, 121 may comprise two detachable parts which are separable from each other along the longitudinal direction LA. When coupled together, the two parts define an enclosed cylindrical receptacle 23, but when separated the two parts enable access to the cylindrical receptacle 23. Thus in the separated state a user can insert or remove a cartridge part 30 by pulling or pushing the cartridge along the direction of the longitudinal axis LA. Alternative mechanisms may include a movable cradle which is hinged to the housing 21 and moves in a direction perpendicular to the longitudinal axis LA, for example. The skilled person will be aware of alternative approaches for enabling loading of the cartridge part 30 into device part 20, 120.

While the above described embodiments have in some respects focussed on some specific example aerosol provision systems, it will be appreciated the same principles can be applied for aerosol provision systems using other technologies. That is to say, the specific manner in which various aspects of the aerosol provision system function are not directly relevant to the principles underlying the examples described herein.

The above disclosure is applicable to systems configured to aerosolise, e.g., via heating, a source liquid, which may or may not contain nicotine, to generate an aerosol. However, it should be appreciated that the disclosure is also applicable to systems configured to release compounds by heating, but not burning, a solid/or amorphous solid substrate material. The substrate material may be for example tobacco or other non-tobacco products, which may or may not contain nicotine. In some systems, the solid/amorphous solid materials are provided in addition to source liquid so that the present disclosure is also applicable to hybrid systems configured to generate aerosol by heating, but not burning, a combination of substrate materials. Other combinations, such as solid and amorphous solid substrate materials also fall within the scope of this disclosure. More generally, the substrate materials may comprise for example solid, liquid or amorphous solid, which may or may not contain nicotine.

In order to address various issues and advance the art, this disclosure shows by way of illustration various embodiments in which the disclosure may be practiced. The advantages and features of the disclosure are of a representative sample of embodiments only, and are not exhaustive or exclusive. They are presented only to assist in understanding and to teach the disclosure. It is to be understood that advantages, embodiments, examples, functions, features, structures, or other aspects of the disclosure are not to be considered limitations on the disclosure as defined by the claims or limitations on equivalents to the claims, and that other embodiments may be utilised and modifications may be made without departing from the scope of the claims. Various embodiments may suitably comprise, consist of, or consist essentially of, various combinations of the disclosed elements, components, features, parts, steps, means, etc. other than those specifically described herein, and it will thus be appreciated that features of the dependent claims may be combined with features of the independent claims in combinations other than those explicitly set out in the claims. The disclosure may include other embodiments not presently claimed, but which may be claimed in future.

The invention claimed is:

1. An aerosol provision system comprising:

a cartridge separable from a control unit, the cartridge comprising:

a reservoir for containing an aerosol precursor material; and an inlet port and an outlet port both fluidly connected to the reservoir; and the control unit, the control unit comprising:

a mouthpiece at one end of the control unit and including an opening through which generated aerosol can be inhaled by a user;

a power supply and a source of pressurized fluid, wherein the control unit is configured to supply the pressurized fluid to the reservoir via the inlet port to increase a pressure within the reservoir relative to a pressure external to the reservoir to force the aerosol precursor material to exit the reservoir via the outlet port, and wherein the control unit comprises an outer housing defining a space within which the power supply and source of pressurized fluid are located;

wherein when the cartridge is coupled to the control unit, the inlet port is located closer to the mouthpiece than the outlet port.

2. The aerosol provision system of claim 1, wherein the outlet port is configured to allow the aerosol precursor material to exit the reservoir via the outlet port when the pressure within the reservoir is greater than or equal to a threshold pressure.

3. The aerosol provision system of claim 1, wherein the source of the pressurized fluid is configured to be able to fluidly communicate with the inlet port of the reservoir.

4. The electronic aerosol provision system of claim 3, wherein the source of the pressurized fluid is at least one of: a pressurized fluid generator for generating pressurized fluid and a store of pre-pressurized fluid.

5. The electronic aerosol provision system of claim 1, wherein the control unit further comprises a controller, the controller configured to control a flow of the pressurized fluid.

6. The electronic aerosol provision system of claim 5, wherein the controller is configured to control an amount of the aerosol precursor material exiting the reservoir by controlling an amount of the pressurized fluid entering the reservoir.

7. The electronic aerosol provision system of claim 6, wherein the controller is configured to receive an input, and control the flow of the pressurized fluid based on the input.

8. The electronic aerosol provision system of claim 1, wherein the outlet port comprises a valve.

9. The electronic aerosol provision system of claim 1, wherein the inlet port comprises a valve.

10. The electronic aerosol provision system of claim 9, wherein the valve of the inlet port is configured to open in response to the pressurized fluid.

11. The electronic aerosol provision system of claim 9, wherein the valve of the inlet port is configured to open when a pressure applied by the pressurized fluid exceeds a first threshold, and wherein a valve of the outlet port is configured to open when the pressure within the reservoir exceeds a second threshold.

12. The electronic aerosol provision system of claim 1, wherein the control unit comprises a pump configured to selectively generate the pressurized fluid, wherein the pump is arranged in fluid communication with the inlet port.

13. The electronic aerosol provision system of claim 1, wherein the control unit comprises a pre-pressurized container containing the pressurized fluid and configured to selectively release the pressurized fluid, wherein the pre-pressurized container is arranged in fluid communication with the inlet port.

14. The electronic aerosol provision system of claim 1, wherein the control unit comprises a housing, the housing defining a pressurized fluid pathway configured to fluidly couple to the inlet port and permit the pressurized fluid to flow along the pressurized fluid pathway to the inlet port.

15. The electronic aerosol provision system of claim 14, wherein the housing further defines an aerosol precursor pathway configured to allow the aerosol precursor material to pass along the aerosol precursor pathway.

16. The electronic aerosol provision system of claim 1, wherein the control unit comprises an atomizer, and wherein the outlet port is arranged such that the aerosol precursor material exiting via the outlet port is atomized by the atomizer.

17. The electronic aerosol provision system of claim 1, wherein the pressurized fluid is a gas.

18. The electronic aerosol provision system of claim 1, wherein the inlet port comprises an inlet valve and the outlet port comprises an outlet valve, and wherein the inlet valve and the outlet valve are configured to be closed when the cartridge is removed from the housing.

19. An aerosol provision device comprising a mouthpiece at one end of the control unit and including an opening through which generated aerosol can be inhaled by a user, a control unit comprising a power supply and a source of pressurized fluid, wherein the control unit is configured to allow the pressurized fluid to enter a reservoir of a cartridge for containing an aerosol precursor material via an inlet port of the cartridge fluidly connected to the reservoir to increase a pressure within the reservoir relative to a pressure external to the reservoir to force the aerosol precursor material to exit the reservoir via an outlet port of the cartridge fluidly connected to the reservoir, and wherein the control unit comprises an outer housing defining a space within which the power supply and the source of pressurized fluid are located, wherein when the cartridge is coupled to the control unit, the inlet port is located closer to the mouthpiece than the outlet port.

20. A cartridge including a reservoir for containing an aerosol precursor material, and an inlet port for receiving a pressurized fluid and an outlet port both fluidly connected to the reservoir, wherein the cartridge is configured to permit release of the aerosol precursor material from the outlet port when a pressure in the reservoir exceeds a threshold value, the cartridge for use with a control unit comprising a power supply and a source of the pressurized fluid, wherein the control unit is configured to supply the pressurized fluid to the reservoir via the inlet port to increase a pressure within the reservoir relative to a pressure external to the reservoir to force the aerosol precursor material to exit the reservoir via the outlet port, and wherein the control unit comprises an outer housing defining a space within which the power supply and the source of pressurized fluid are located, wherein the control unit comprises a mouthpiece at one end of the control unit and including an opening through which generated aerosol can be inhaled by a user, and wherein when the cartridge is coupled to the control unit, the inlet port is located closer to the mouthpiece than the outlet port.

21. A method of dispensing aerosol precursor material from a cartridge separable from a control unit, the cartridge comprising a reservoir, the reservoir comprising an inlet port and an outlet port fluidly coupled to the reservoir, the control unit comprising a mouthpiece at one end of the control unit and including an opening through which generated aerosol can be inhaled by a user, a power supply and a source of pressurized fluid, wherein the control unit is configured to supply the pressurized fluid to the reservoir via the inlet port to increase a pressure within the reservoir relative to a pressure external to the reservoir to force the aerosol precursor material to exit the reservoir via the outlet port, wherein the control unit comprises an outer housing defining a space within which the power supply and the source of pressurized fluid are located, and wherein when the cartridge is coupled to the control unit, the inlet port is located closer to the mouthpiece than the outlet port, the method comprising:

permitting the pressurized fluid to enter the reservoir via the inlet port to increase the pressure within the reservoir relative to the pressure external to the reservoir, and dispensing the aerosol precursor material from the reservoir in response to the increased pressure forcing the aerosol precursor material to exit the reservoir via the outlet port.

22. A method of dispensing aerosol precursor material from a cartridge separable from a control unit, the cartridge comprising a reservoir, the control unit comprising a mouthpiece at one end of the control unit and including an opening through which generated aerosol can be inhaled by a user, a power supply and a source of pressurized fluid, wherein the control unit is configured to supply the pressurized fluid to the reservoir to increase a pressure within the reservoir relative to a pressure external to the reservoir to force the aerosol precursor material to exit the reservoir, wherein the control unit comprises an outer housing defining a space within which the power supply and the source of pressurized fluid are located, and wherein when the cartridge is coupled to the control unit, the inlet port is located closer to the mouthpiece than the outlet port, the method comprising:

increasing the pressure within the reservoir to a value greater than or equal to a threshold value, above which the aerosol precursor material is permitted to exit the reservoir and below which the aerosol precursor material is not permitted to exit the reservoir.

23. The method of claim 21, wherein the pressure within the reservoir is a first value prior to increasing the pressure in the reservoir, and wherein the pressure within the reservoir increases to a second value, before dropping to a third value when the aerosol precursor material exits the reservoir.

* * * * *